US009353986B2

(12) United States Patent
Delgadillo

(10) Patent No.: US 9,353,986 B2
(45) Date of Patent: May 31, 2016

(54) GLYCOL PAN CHILLER SYSTEMS

(71) Applicant: Hector Delgadillo, Duarte, CA (US)

(72) Inventor: Hector Delgadillo, Duarte, CA (US)

( * ) Notice: Subject to any disclaimer, the term of this patent is extended or adjusted under 35 U.S.C. 154(b) by 410 days.

(21) Appl. No.: 13/970,041

(22) Filed: Aug. 19, 2013

(65) Prior Publication Data

US 2014/0230468 A1 Aug. 21, 2014

Related U.S. Application Data

(60) Provisional application No. 61/766,504, filed on Feb. 19, 2013.

(51) Int. Cl.

| | |
|---|---|
| ***F25D 17/02*** | (2006.01) |
| ***F25D 23/06*** | (2006.01) |
| ***F25D 11/00*** | (2006.01) |
| ***F25D 31/00*** | (2006.01) |

(52) U.S. Cl.

CPC ..... *F25D 23/061* (2013.01); *F25D 11/00* (2013.01); *F25D 31/00* (2013.01); *F25D 17/02* (2013.01)

(58) Field of Classification Search

CPC ..... F25D 23/061; F25D 31/003; F25D 11/00; F25D 17/02

USPC ..... 62/99, 451, 185; 165/104.14; 99/517

See application file for complete search history.

(56) References Cited

U.S. PATENT DOCUMENTS

| | | | | |
|---|---|---|---|---|
| 5,117,649 | A * | 6/1992 | Mangini et al. | 62/251 |
| 5,181,395 | A | 1/1993 | Carpenter et al. | |
| 5,355,687 | A | 10/1994 | Carpenter et al. | |
| 5,678,421 | A * | 10/1997 | Maynard et al. | 62/407 |
| 5,727,393 | A * | 3/1998 | Mahmoudzadeh | 62/81 |
| 5,927,092 | A | 7/1999 | Kushen et al. | |
| 6,145,333 | A * | 11/2000 | Richmond et al. | 62/258 |
| 7,069,732 | B2 * | 7/2006 | Walker et al. | 62/99 |
| 2006/0201177 | A1 | 9/2006 | Spillner | |
| 2006/0230948 | A1 | 10/2006 | Matus | |
| 2009/0013707 | A1 | 1/2009 | Spillner | |
| 2011/0072849 | A1 * | 3/2011 | Kuehl et al. | 62/498 |
| 2015/0173526 | A1 * | 6/2015 | Delgadillo | 62/99 |

* cited by examiner

*Primary Examiner* — Allen Flanigan
*Assistant Examiner* — Joseph Trpisovsky
(74) *Attorney, Agent, or Firm* — Steven A. Nielsen; www.NielsenPatents.com

(57) ABSTRACT

A glycol pan chiller comprises a cooling area 110 cooled by glycol contained within a glycol void area 130, the void area defined within an inner liner 160. Under normal conditions, the glycol will remain stationary within the inner liner and will be chilled by a refrigerant line 140 contained within the glycol void area. For optional cooling, a separate glycol tank 230, stored away from the inner liner, is cooled by the refrigerant system, upon the cooling area 110 reaching a predetermined temperature, cooled glycol is circulated within the glycol void area.

10 Claims, 12 Drawing Sheets

GLYCOL PAN CHILLER SYSTEMS

CROSS-REFERENCE TO RELATED APPLICATIONS

This is a utility application based upon U.S. patent application Ser. No. 61/766,504, entitled "Glycol Pan Chiller Systems" filed on Feb. 12, 2013. This related application is incorporated herein by reference and made a part of this application. If any conflict arises between the disclosure of the invention in this utility application and that in the related provisional application, the disclosure in this utility application shall govern. Moreover, the inventors incorporate herein by reference any and all patents, patent applications, and other documents hard copy or electronic, cited or referred to in this application.

BACKGROUND OF THE INVENTION (1) Field of the Invention

The invention generally relates to refrigeration systems. More particularly, the invention relates to means and methods of producing and using glycol pan chiller systems.

(2) Description of the Related Art

The use of glycol in cooling systems is known in general, but the prior art fails to teach, suggest or motivate one skilled in the art to construct the disclosed embodiments.

Several systems by KAIRAK are known in the art. For example U.S. Pat. Nos. 5,181,395 "Condenser Assembly", 5,927, 092 "Food Pan Refrigeration Unit" and 5,355,687 "Pan Cooler and Method" disclose various refrigeration systems. While the known KAIRAK patents disclose various physical configurations of assembling cooling systems the KAIRAK patents fail to address the shortfalls in the art.

The known relevant published patent applications teach means and methods of protecting food held in a chiller and blowing cold air over food. Such published patent applications include 20090013707 Air blanketed food preparation table; 20060230948 Food Protector Apparatus that Attaches to a Drop-In Food pan and method and 20060201177 Air Blanketed Food Preparation Table. Thus, the trend in the art is to focus upon the protection of food in a chiller, blowing cold air directly upon food and to remain satisfied with the chilling methods of the prior art.

There are many shortfalls in the prior art. For example, the chillers of the prior art typically use 20 year old technology and fail to artfully integrate the use of both glycol and refrigerant systems. Chillers in the prior art fail to efficiently and economically cool chill pans and related assemblies. For example, chillers of the prior art often use non removable foam material to encase refrigerant lines wrapping a chiller. When a refrigerant line leaks, the unit is not economically repairable. The prior art is prone to condensation problems as well. The prior art is prone to blow cold air directly upon food, causing condensation problems and problems with drying out food.

BRIEF SUMMARY OF THE INVENTION

The present invention overcomes shortfalls in the related art by presenting an unobvious and unique combination and configuration of liners, liner installation systems, use of refrigerant lines, use of glycol flowing in contact with refrigerant lines, with the glycol in a static state or moving state, and other components to provide self-contained refrigeration systems suitable for preparation tables and other functions.

The present invention overcomes shortfalls in the art by eschewing the practice of blowing chilled air over food held in a cooler. This solution is known to dry out food. The prior art disclosures also teach methods of blowing cool air to the undersides of a pan chiller or pan container of food. The utility of blowing cool air to the undersides of a chiller is severely limited by the thermal properties of air. In acknowledgement of this shortfall, KAIRAK U.S. Pat. No. 5,927,092 uses cooling fins attached to the chiller in an effort to improve its air cooled system. In the automotive industry, air cooled engines were replaced long ago with liquid cooled engines. But, KAIRAK remains entrenched in the prior art and teaches away from the liquid cooled systems of the present invention.

The present invention overcomes shortfalls in the art by disclosing a new pan system that is quickly and economically removable from a separate foam installation system. Embodiments of the invention solve problems in the prior art by providing an efficient retro fit system to repair broken cooler pans of the prior art.

The disclosed embodiments have provided unexpected and dramatically favorable results in cooling efficiency by ignoring the air fins and air cooling system of KAIRAK and by using a new inner liner system comprising a refrigerant line wrapped upon an inner wall of an inner liner. The inner liner is filled with circulating glycol or other coolant fluid which is separately cooled, or the glycol may remain static. When food areas become too warm, the glycol may circulate within a refrigerant cooled glycol tank to further cool the glycol and food storage areas. The artful combination of refrigerant lines and a glycol fluid body in contact with both the refrigerant lines and pan liners satisfies long felt needs in the art with new power and space efficiencies and economic advantages.

Disclosed embodiments include a cabinet system wherein a separate refrigeration unit for the refrigerant is held with a separate refrigeration unit for the glycol. Disclosed configurations overcome shortfalls in the prior art wherein pizza flour and other particulates would fowl refrigerant condensing units.

Disclosed embodiments include a glycol tank wherein glycol is held and cooled in reserve such that cooled glycol is ready for circulation when needed.

These and other objects and advantages will be made apparent when considering the following detailed specification when taken in conjunction with the drawings.

REFERENCE NUMERALS IN THE DRAWINGS

100 pan chiller assembly in general

Figure 1:
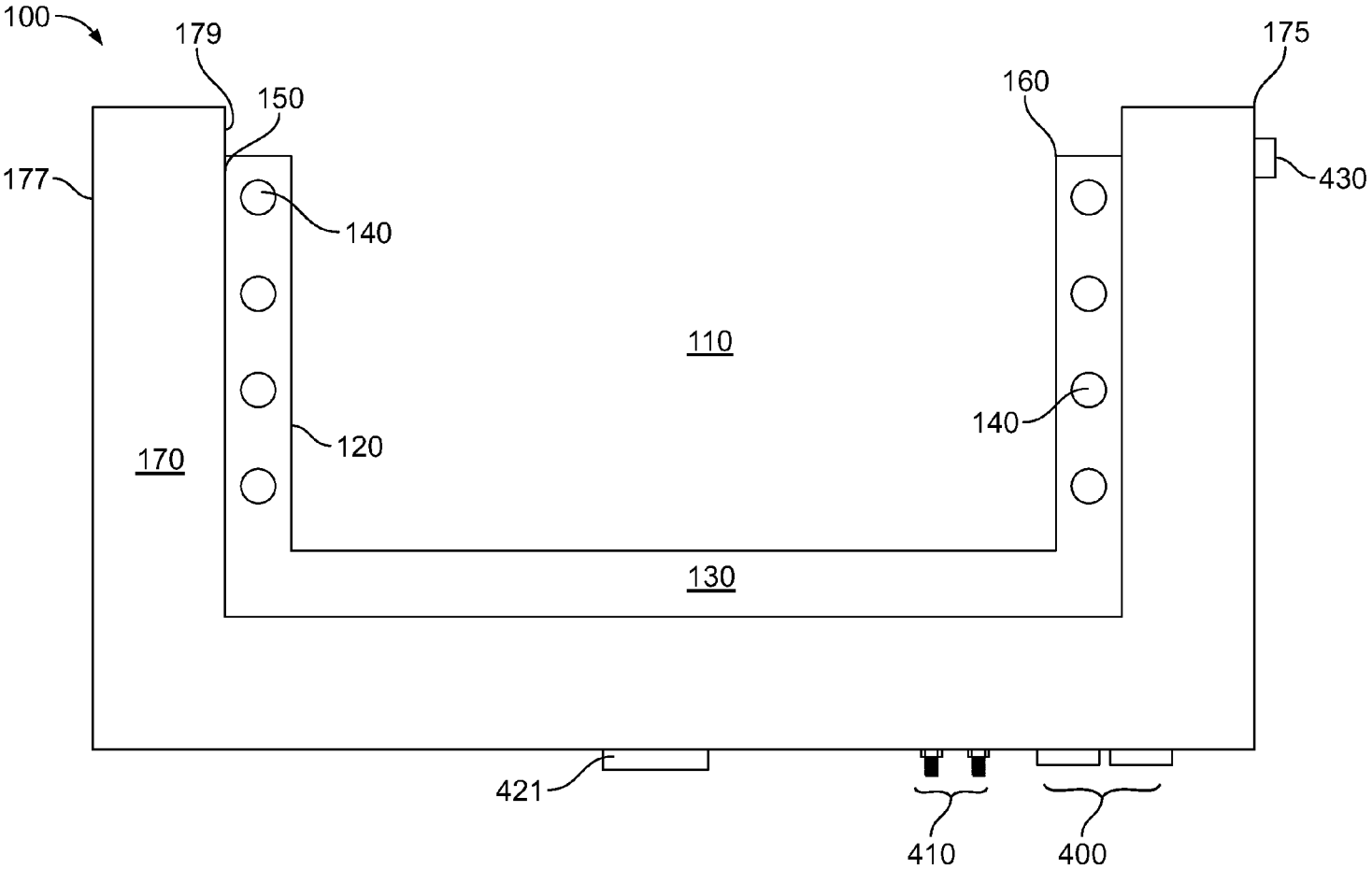
FIG. 1 is a section view of a disclosed embodiment

110 cooling void area within inner liner 160

120 inner wall of inner liner
130 void area within inner liner 160, sometimes called a glycol void area, sometimes filled with glycol and including refrigerant flow line 140
140 refrigerant flow line wrapped within inner liner 160
141 a refrigerant flow line in general
142 refrigerant inlet to refrigerant flow line 140
144 refrigerant outlet of glycol flow line 140
150 outer wall in inner liner
160 inner liner in general
170 insulation area of outer liner sometimes comprised of foam
175 insulation liner in general
177 outer shell of outer liner 175
179 inner wall or inner shell of outer liner 175
200 Turbo Coil System or other system used to cool refrigerant or other fluid contained within the inner liner or refrigerant lines. May include evaporation coils and fans.
210 recirculating pump
215 refrigerant pipe leading to system 200 used to cool refrigerant
220 glycol pipe leading from system 200 to the pan chiller 100 in general or to the void area 130 filled with Glycol
242 insulation around the glycol tank 230
225 a glycol flow line in general
230 glycol tank
231 lid to glycol tank 230
232 direction of air flow
233 air filter
234 electrical power supply
235 glycol pump
236 compressor
237 intake for refrigerant lines within the refrigerant tank 230
240 refrigerant lines within the glycol tank 231
242 insulation around the glycol tank 230
250 compressor and condensation compartment
300 generic refrigeration condensing and compressor unit used to cool refrigerant
310 condenser unit or condenser coil
312 compressor unit
315 DX TXV direct expansion thermal expansion valve
320 liquid line solenoid valve and coil
400 drain and entry attachments to refrigerant lines and refrigerant cooling system 300
410 drain and entry attachments for connections to and from system 200 used to cool glycol
421 attachment area for condensation removal
430 attachment area for connection to glycol
500 a disclosed preparation table
510 a tray shelf
520 a lid or cover
530 vent door
540 refrigeration door
545 service panel
550 support bar
555 raised chamber
560 pans for storing food on upper side of table
565 internal food draws
570 external drawer cover
575 compartment for cooling systems
580 lower interior compartment
582 interior shelf
584 interior shelf support structure
586 floor of lower interior compartment 580
587 back wall of interior compartment 580
588 ceiling of interior compartment 580
600 digital thermometer inside housing
700 lower insulation

DETAILED DESCRIPTION OF EMBODIMENTS OF THE INVENTION

The following detailed description is directed to certain specific embodiments of the invention. However, the invention can be embodied in a multitude of different ways as defined and covered by the claims and their equivalents. In this description, reference is made to the drawings wherein like parts are designated with like numerals throughout.

Unless otherwise noted in this specification or in the claims, all of the terms used in the specification and the claims will have the meanings normally ascribed to these terms by workers in the art.

Unless the context clearly requires otherwise, throughout the description and the claims, the words "comprise," "comprising" and the like are to be construed in an inclusive sense as opposed to an exclusive or exhaustive sense; that is to say, in a sense of "including, but not limited to." Words using the singular or plural number also include the plural or singular number, respectively. Additionally, the words "herein," "above," "below," and words of similar import, when used in this application, shall refer to this application as a whole and not to any particular portions of this application.

The above detailed description of embodiments of the invention is not intended to be exhaustive or to limit the invention to the precise form disclosed above. While specific embodiments of, and examples for, the invention are described above for illustrative purposes, various equivalent modifications are possible within the scope of the invention, as those skilled in the relevant art will recognize. For example, while steps are presented in a given order, alternative embodiments may perform routines having steps in a different order. The teachings of the invention provided herein can be applied to other systems, not only the systems described herein. The various embodiments described herein can be combined to provide further embodiments. These and other changes can be made to the invention in light of the detailed description.

Any and all the above references and U.S. patents and applications are incorporated herein by reference. Aspects of the invention can be modified, if necessary, to employ the systems, functions and concepts of the various patents and applications described above to provide yet further embodiments of the invention.

These and other changes can be made to the invention in light of the above detailed description. In general, the terms used in the following claims, should not be construed to limit the invention to the specific embodiments disclosed in the specification, unless the above detailed description explicitly defines such terms. Accordingly, the actual scope of the invention encompasses the disclosed embodiments and all equivalent ways of practicing or implementing the invention under the claims.

Referring to FIG. 1, a disclosed pan chiller assembly 100, chiller barrel or liner assembly is shown in a general configuration and may comprise a cooling void area 110 defined within an inner liner 160. The cooling void area 110 may contain food products or pans containing food products.

The inner liner 160 may comprise an inner wall 120 and an outer wall 150. A glycol void area 130 may be defined within the inner wall 120 and outer wall 150. The glycol void area 130 may contain glycol or other fluid. refrigerant flow lines 140 may also be disposed within the glycol void area and used to cool the glycol or other fluid. The refrigerant flow lines may be secured anywhere within the inner liner 160, but are often secured to the inner wall 150 of the inner liner.

The inner liner 160 may be disposed within an insulation liner 175. The insulation liner 175 liner may be removable and may be well suited to retrofit existing systems. The insulation liner 175 may comprise an insulation layer 170 and an outer shell 177 and an inner shell 179 or surface. The inner shell 179 of the insulation layer may rest adjacent to the outer wall 150 of the inner liner 160.

A first set of drain and entry lines 410 may assist in the optional circulation of glycol while a second set of drain and entry lines 400 may assist in the circulation of refrigerant within the refrigerant lines 140. An attachment area 421 may be disposed at the bottom of the insulation liner and used to assist in drainage.

Upper attachment area 430 provides another optional attachment point for the supply of glycol to the glycol void area.

Figure 2:
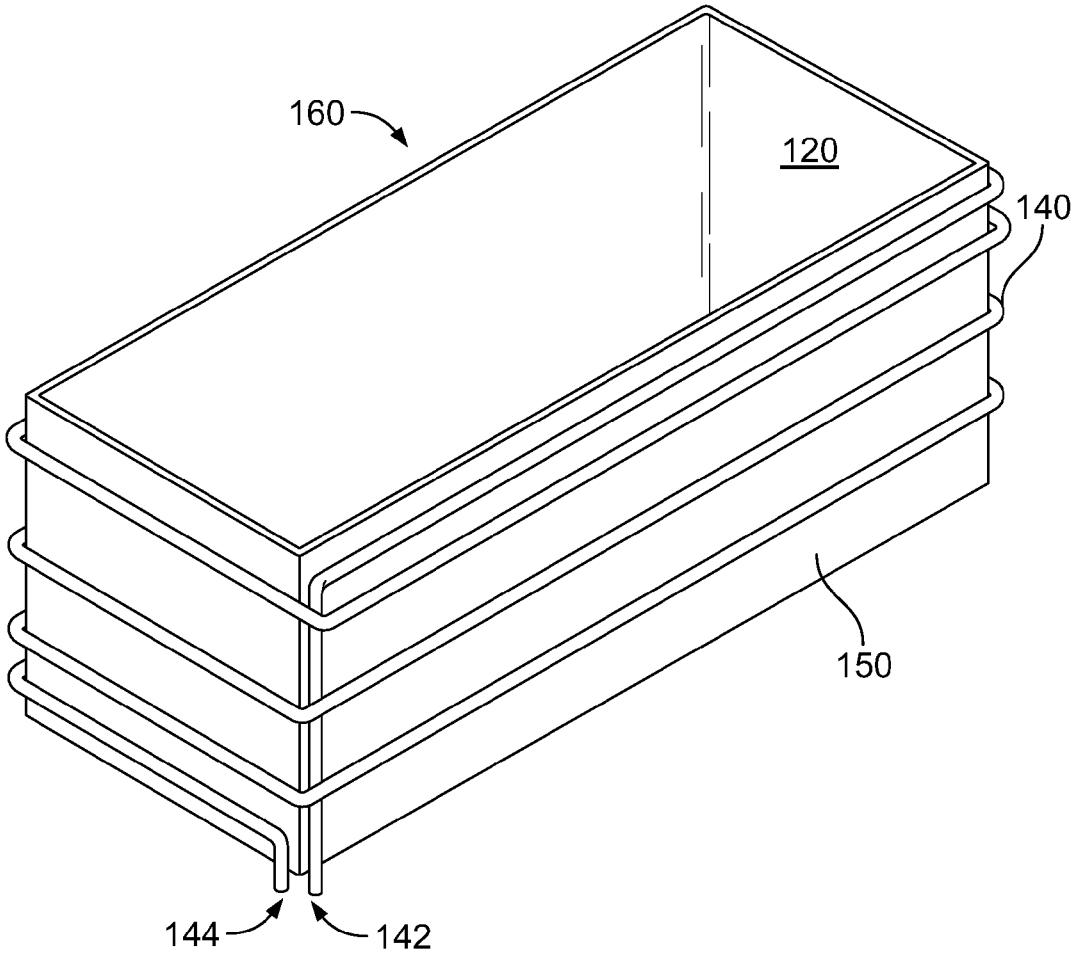
FIG. 2 depicts a perspective view of an inner liner

FIG. 2 depicts a disclosed embodiment wherein an inner liner 160 comprises a tub like structure having an inner wall 120 and an outer wall 150. FIG. 2 depicts the outer wall 150 wrapped with a refrigerant line 140. The refrigerant line 140 may be adjacent to or touching the outer wall 150. FIG. 2 further depicts a refrigerant outlet 144 and a refrigerant inlet 142. The freon line 140 may be placed anywhere within the glycol void area.

Figure 3:
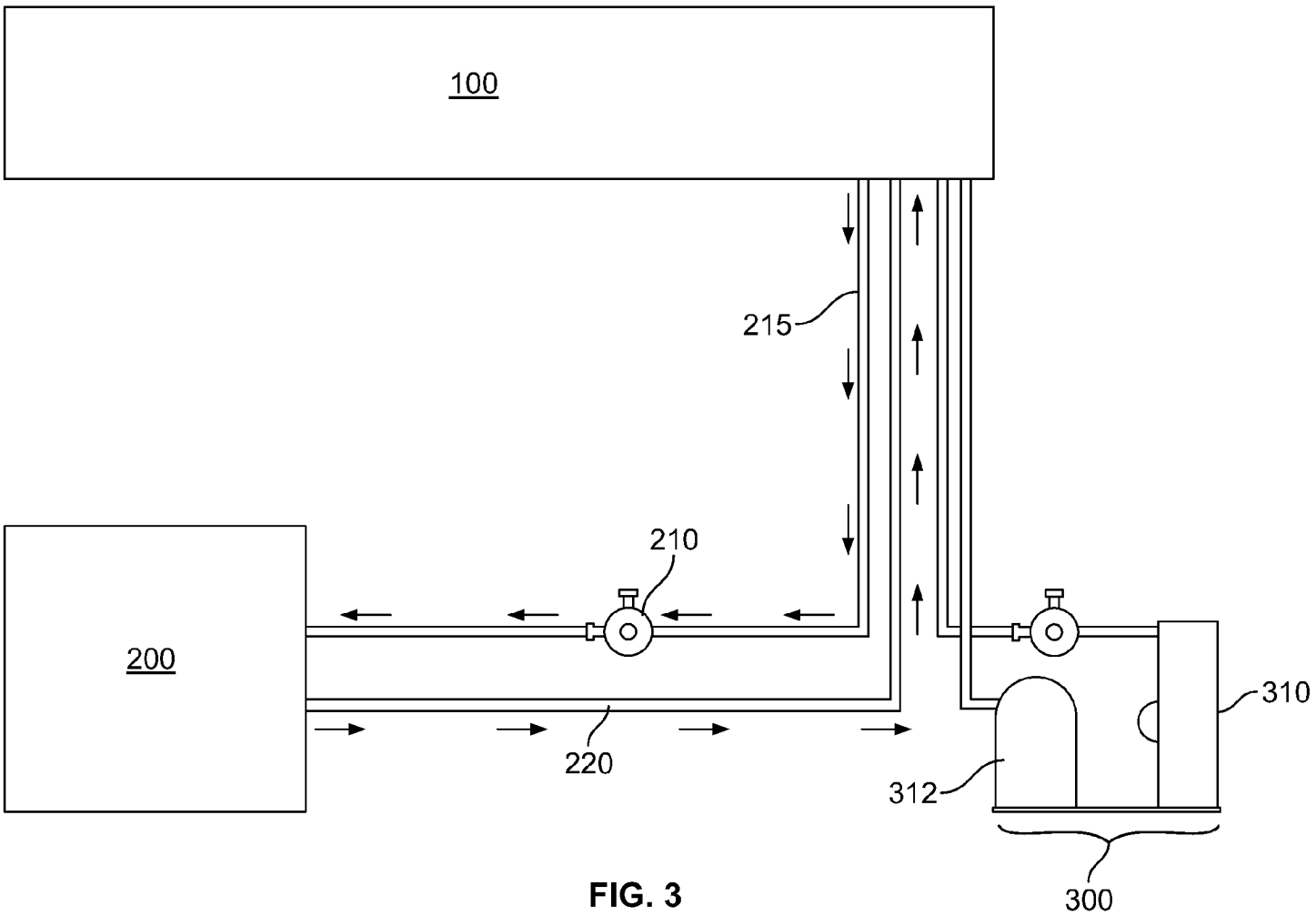
FIG. 3 depicts a disclosed cooling system

FIG. 3 depicts a disclosed system comprising a pan chiller assembly or chiller barrel 100, a Turbo Coil unit or other unit cooler 200 used to cool the refrigerant circulating within the pan chiller 100. FIG. 3 shows generally a refrigerant system used to supply refrigerant into the refrigerant lines of the refrigerant void area of FIG. 1.

A refrigeration condensation unit 310 and compression unit 312 are used to assist in cooling the refrigerant. The condensation unit and compression or compressor unit are sometimes described together as generic refrigeration condensing and compress unit 300. Supply lines 215 are shown to circulate refrigerant or other coolant fluid to and from the generic refrigeration condensing and compressor unit 300, the pan chiller assembly 100 and the Turbo Coil System or other cooling system 200. Recirculating pumps 210 are used within the supply lines 215.

In one disclosed embodiment, a condensing unit chills the refrigerant that flows into the pan chiller 100. The condensing unit shuts down upon a command issued by a temperature thermostat reading the temperature of a food storage area.

A base assembly, not shown, comprises a base with the base having a temperature thermostat measuring the air temperature of the base area. The temperature thermostat of the base area controls a condensing unit to adjust the temperature of the refrigerant.

Figure 4:
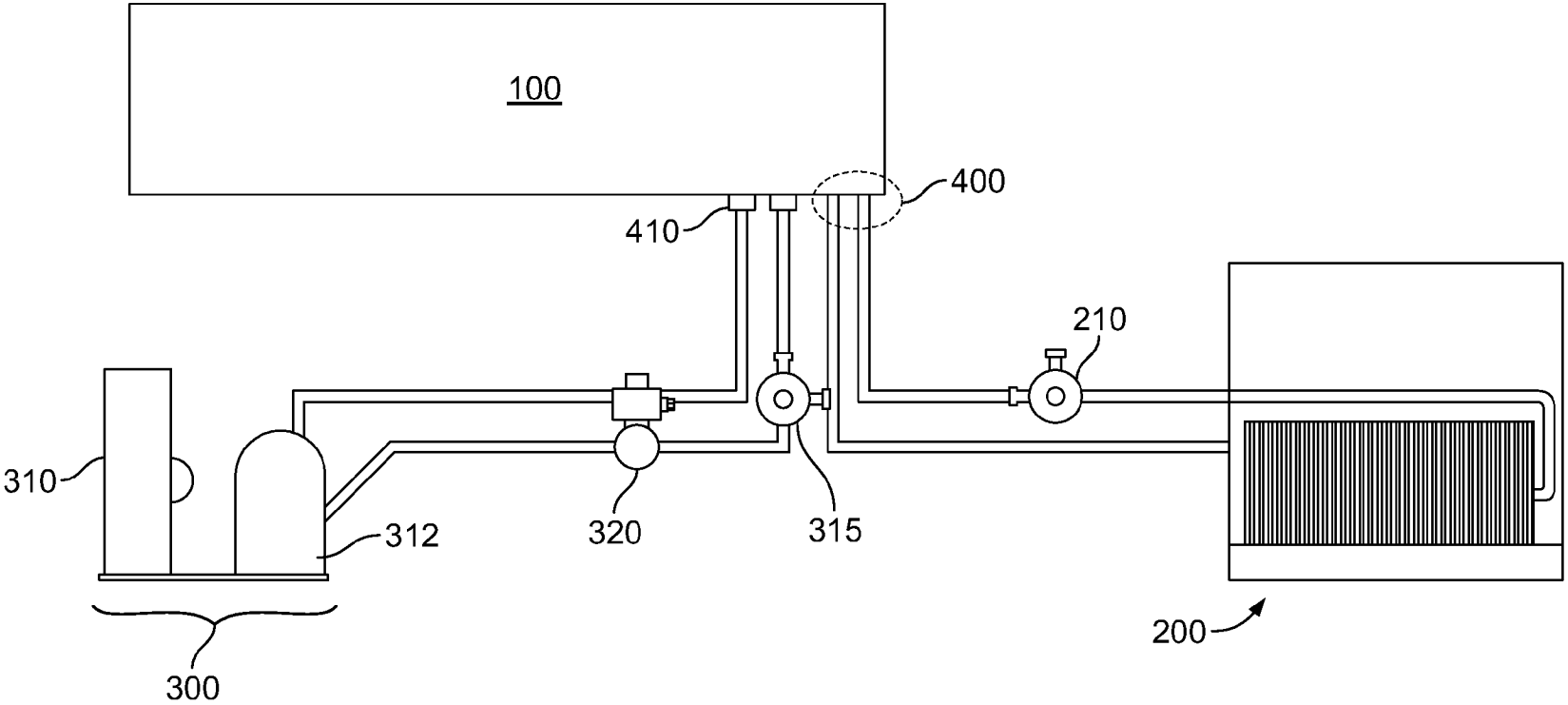
FIG. 4 depicts a disclosed cooling system

FIG. 4 depicts a self-contained preparation table embodiment comprising a pan chiller assembly 100, a unit cooler 200 to cool the refrigerant and a generic refrigeration condensing unit and compressor unit 300. Various valves and motors are depicted such that one reasonably skilled in the art could make and practice the disclosed embodiment. Such ancillary components include a recirculating pump 210, DX TXV 315 direct expansion thermal expansion valve and a liquid line solenoid valve and coil 320.

Figure 5:
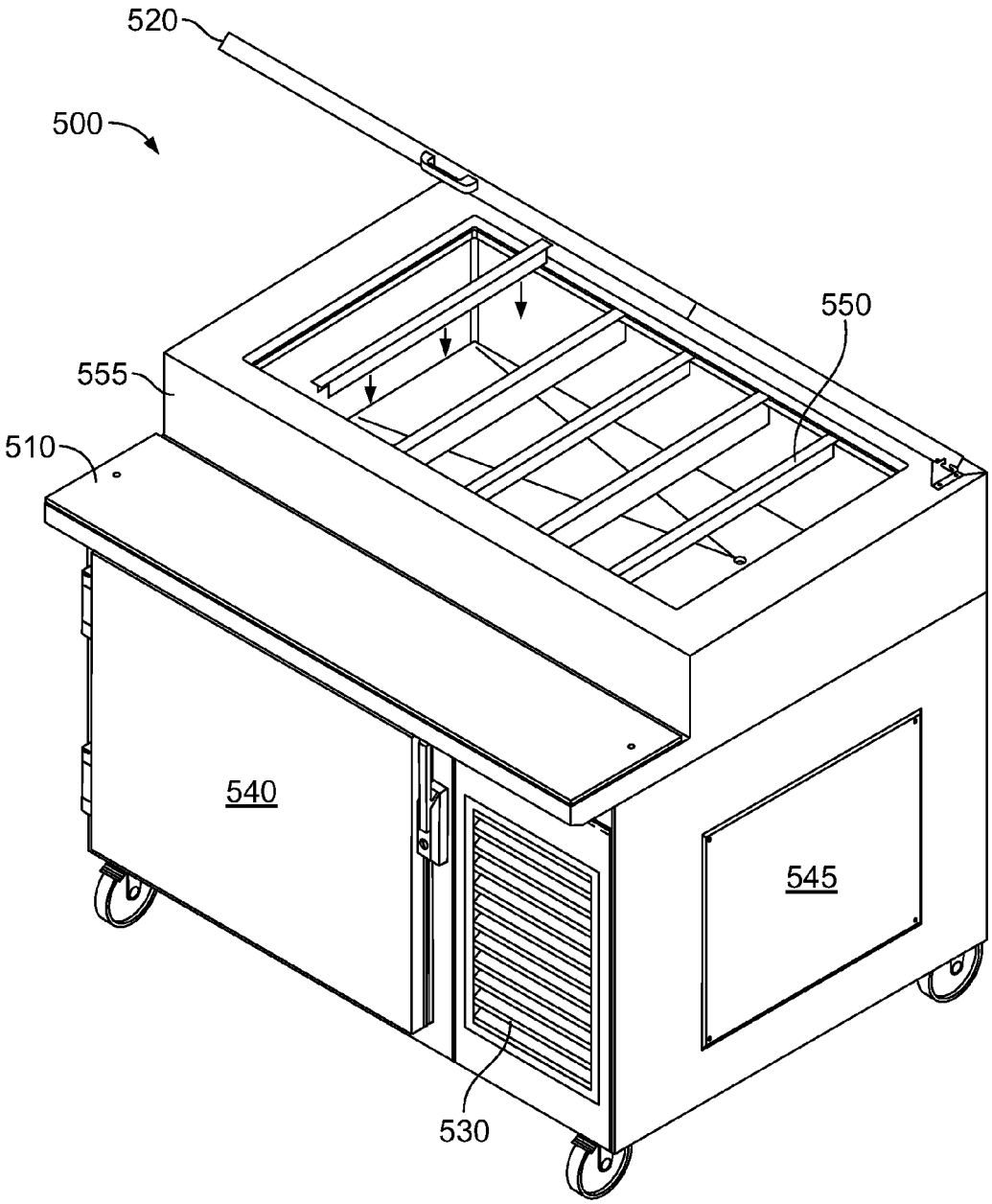
FIG. 5 depicts a perspective view of a disclosed embodiment
Figure 9:
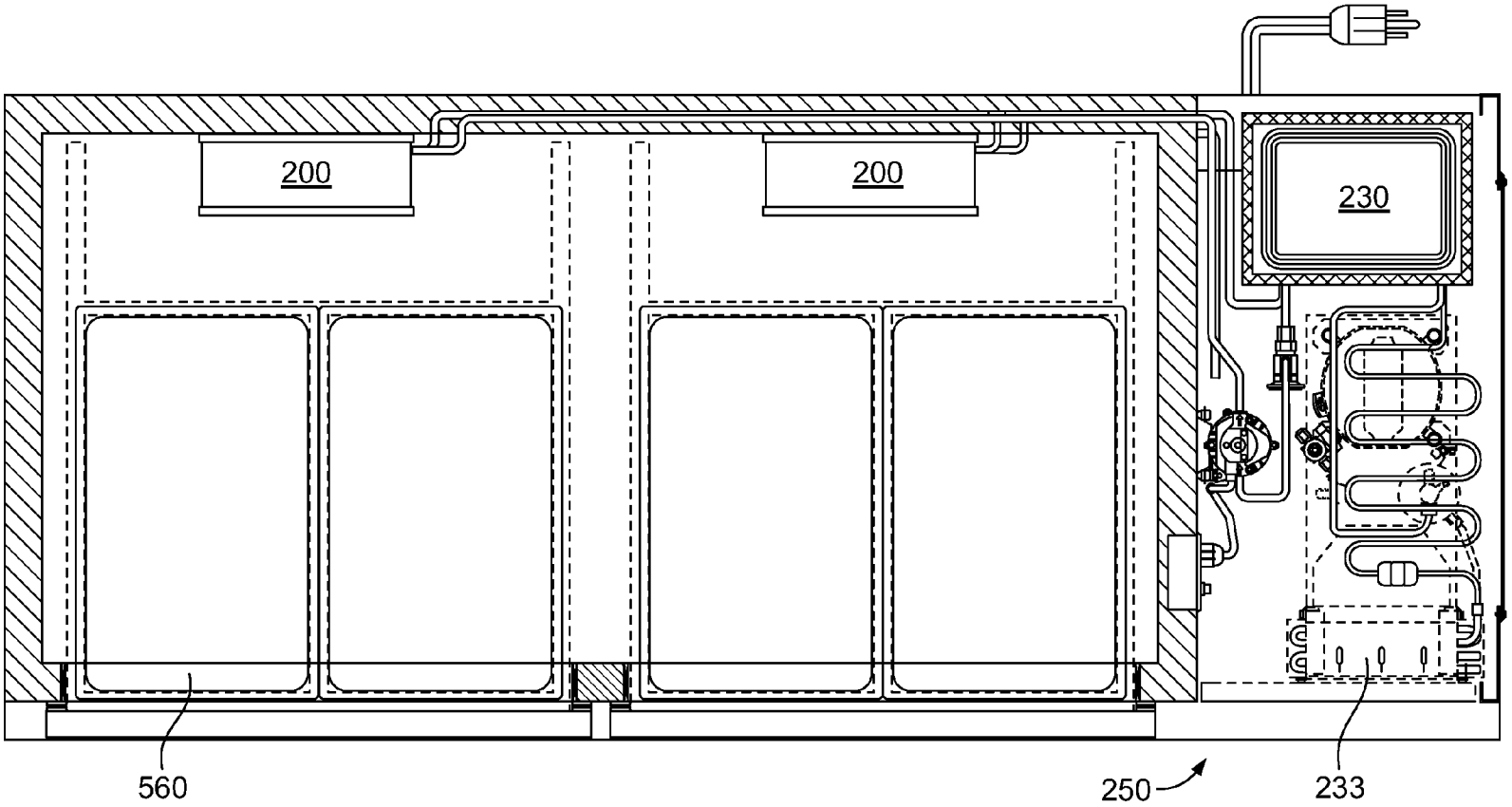
FIG. 9 depicts a disclosed embodiment

FIG. 5 depicts a disclosed housing 500 comprising a lid 520 or cover, support bars 550 sometimes used to support pans of food, a raised chamber 555, a tray shelf 510 or work shelf, a refrigeration door 540, a service panel and a vent door 530. The vent door may open to a compressor and condensation compartment 250 as shown in FIG. 9.

Figure 6:
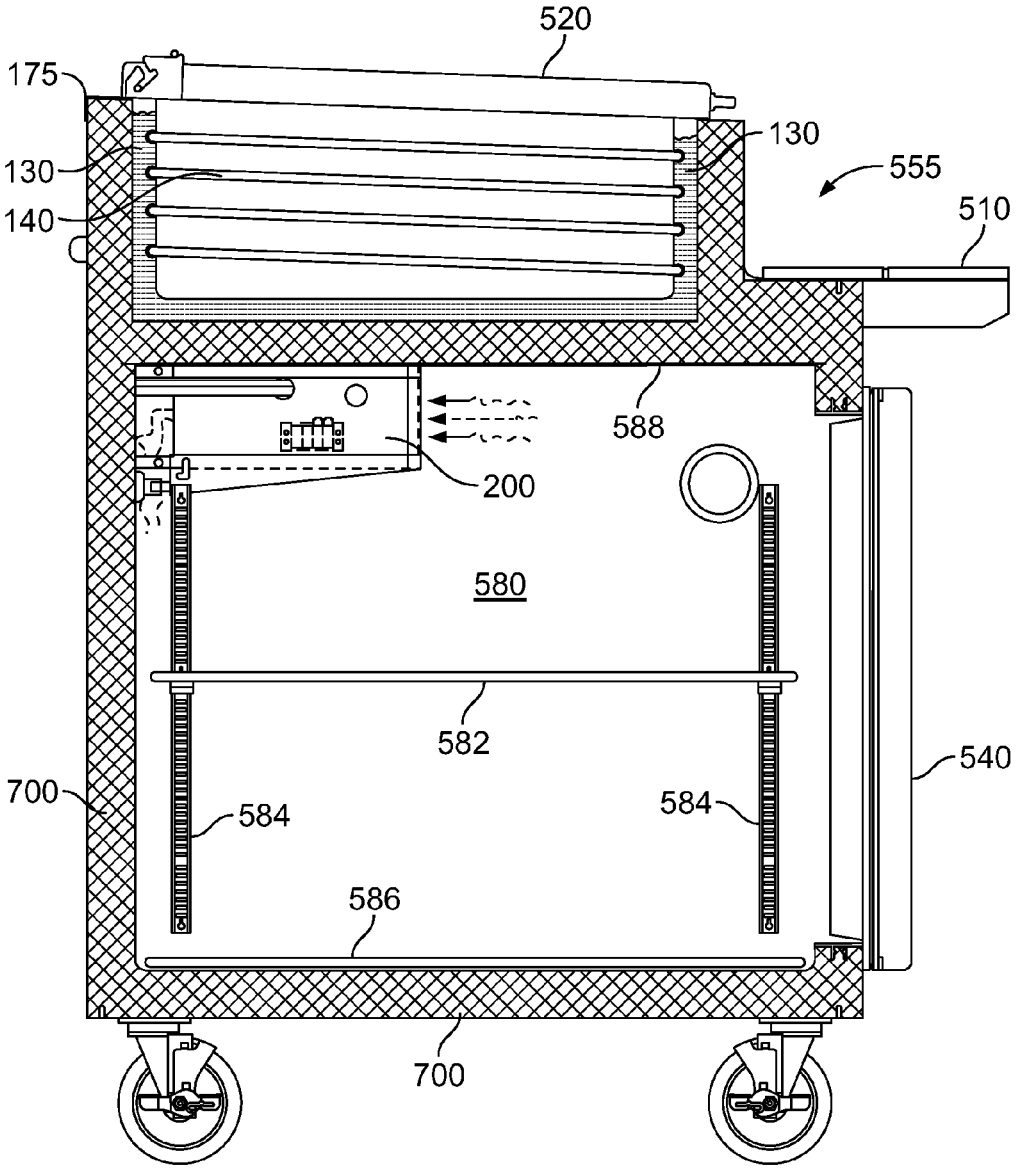
FIG. 6 depicts a side sectional view of a disclosed embodiment

FIG. 6 depicts a section and elevation view of a disclosed configuration comprising lower insulation 700, a refrigeration door 540, and interior compartment 580 a pair of interior shelf support 584 structures, an interior shelf 582 and a refrigerant cooling component 200. Toward the top, a tray shelf 510 is adjacent to a raised chamber 555, the raised chamber including an insulation liner 175, a void area 130 or Glycol void area 130 defined within a liner; a refrigerant flow line 140 is disposed within the Glycol void area 130 and cools glycol contained within the glycol void area 130.

Figure 7:
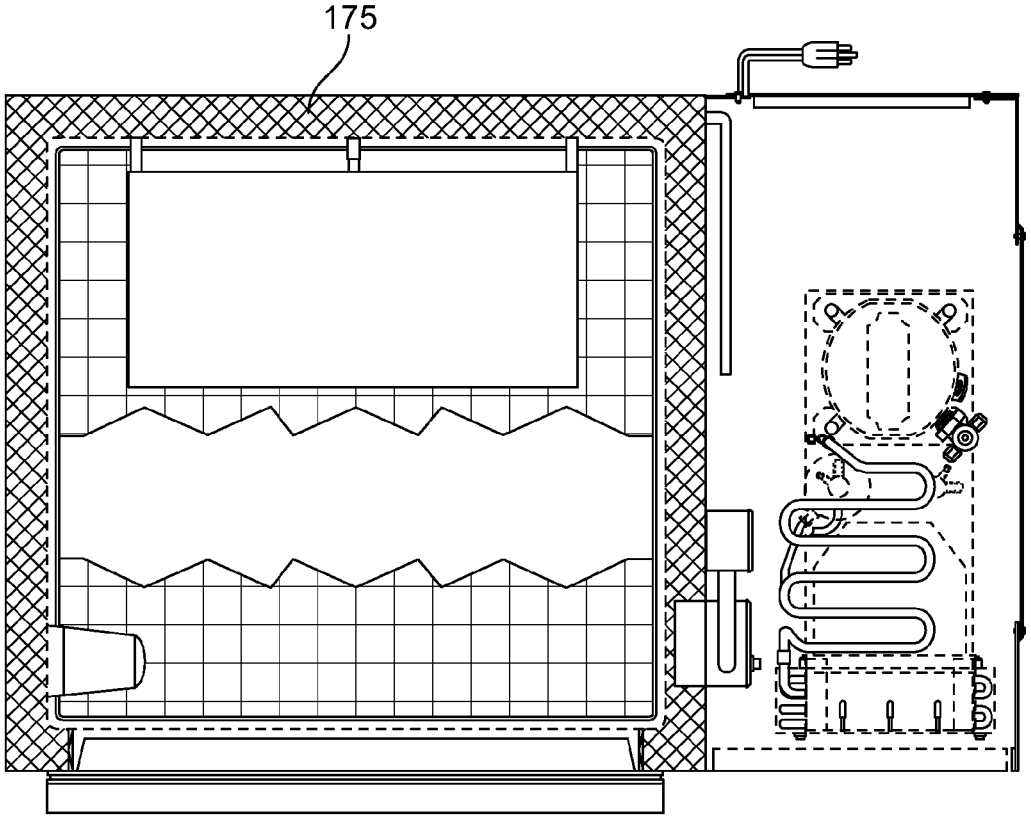
FIG. 7 depicts a sectional view of a disclosed embodiment

FIG. 7 depicts a plan view of a disclosed embodiment and depicts insulation liner components 175.

Figure 8:
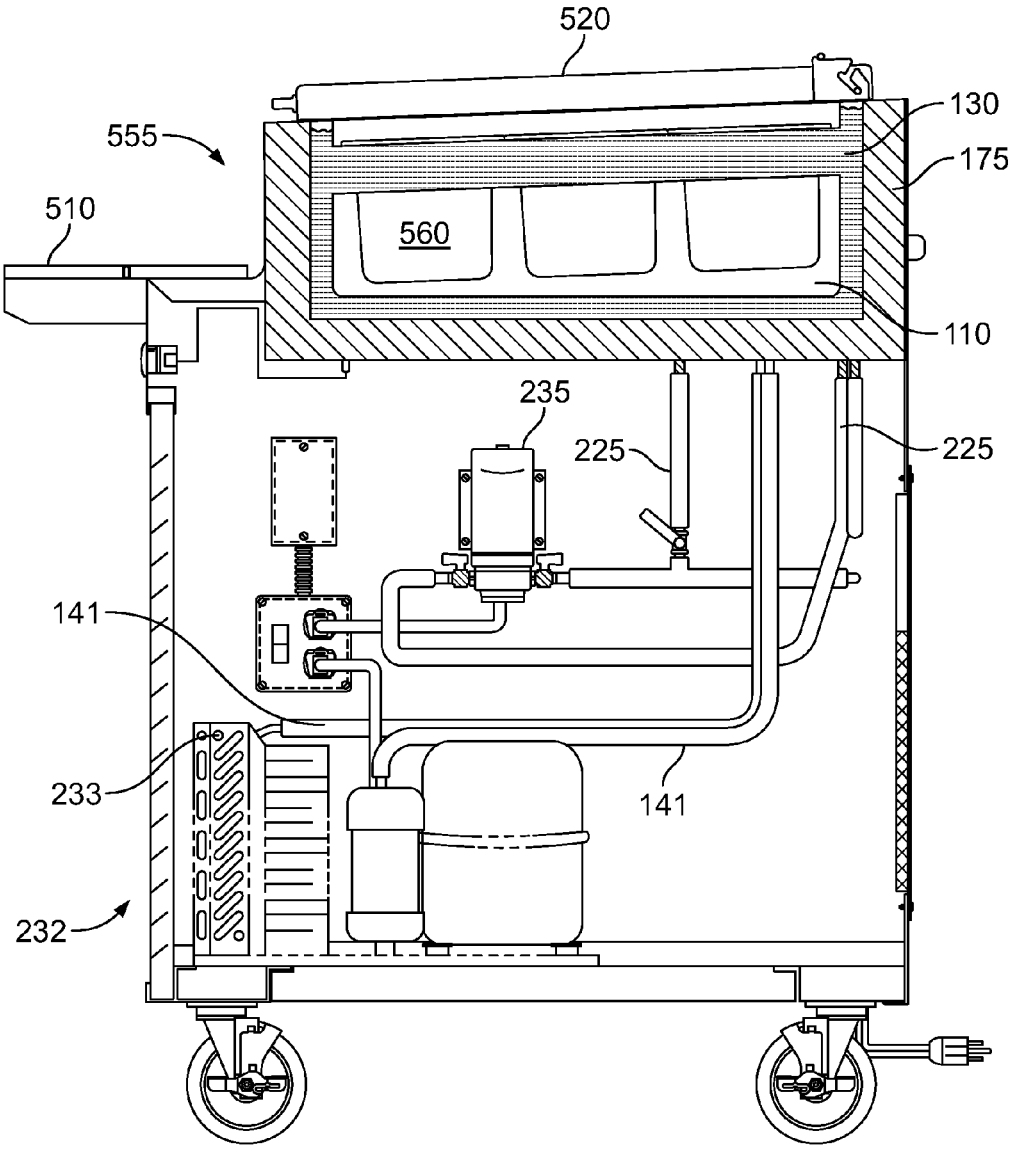
FIG. 8 depicts a side sectional view of a disclosed embodiment

FIG. 8 depicts a side sectional view of a disclosed embodiment comprising a lid 520, a Glycol void area 130, insulation liner 175, a plurality of food storage pans 560, a raised chamber 555 and a tray shelf 510. Also shown are a plurality of Glycol flow lines 225, and a Glycol pump 235. For the refrigerant system, a direction of air flow 232 directs ambient air into a filter 233, general refrigerant flow lines 141 and other components. The plurality of food pans 560 may sit within a cooling void area 110 defined by the most inner walls of the inner liner. The artful combination of the cooling void area 110, lid 520 adjacent to the top openings of the food pans, and glycol vid area 130 provide advantages over the prior art. The disclosed lid system does not blow air over the contents of the food storage pans 560.

FIG. 9 depicts a top plan view of a disclosed embodiment comprising a plurality of food storage pans and a new glycol tank system 230. The glycol tank 230 may be filled with glycol and cooled by pipe lines filled with cooled refrigerant. The cooled glycol within the glycol tank 230 may be circulated, as needed, within the glycol void area of the liner, as shown in FIG. 1. New efficiencies are achieved by using the existing refrigerant cooling system and refrigerant lines to continuous cool the glycol stored within the glycol tank. Thus, cooled glycol is always on hand to quickly provide additional cooling to the pan chiller system as needed.

Figure 10:
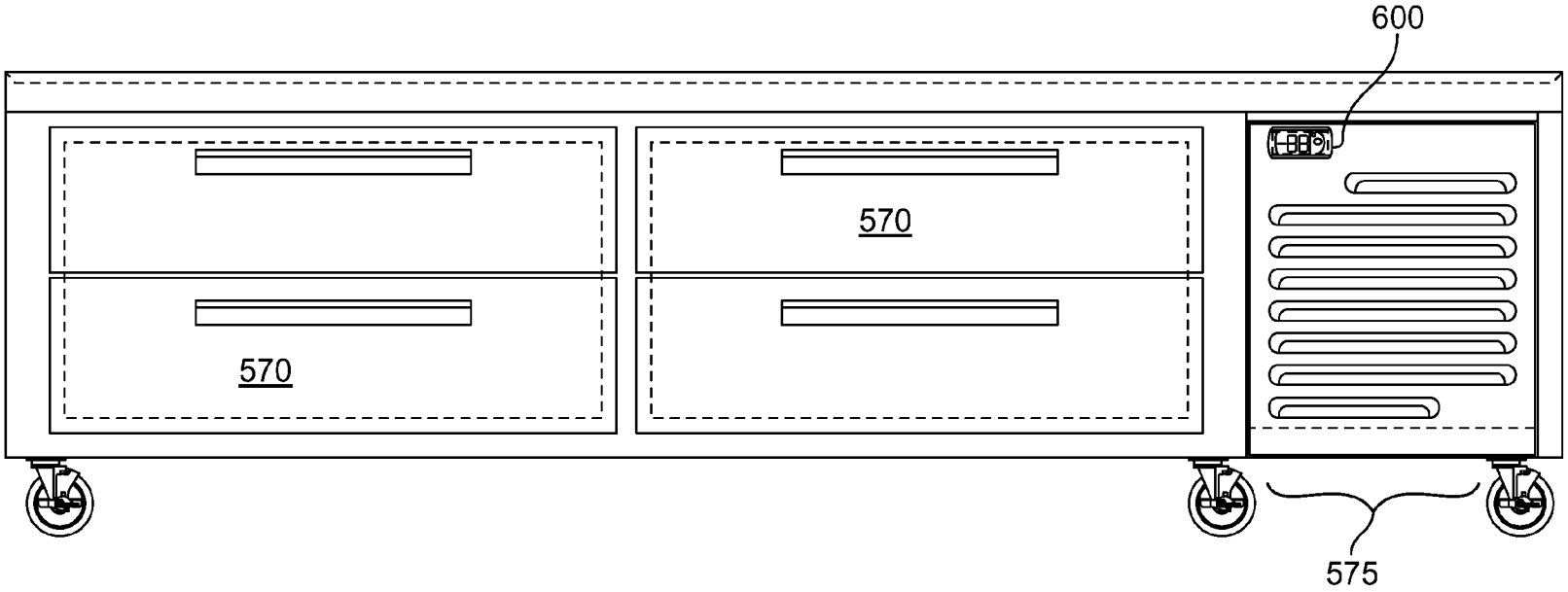
FIG. 10 depicts an elevation view of a disclosed embodiment
Figure 11:
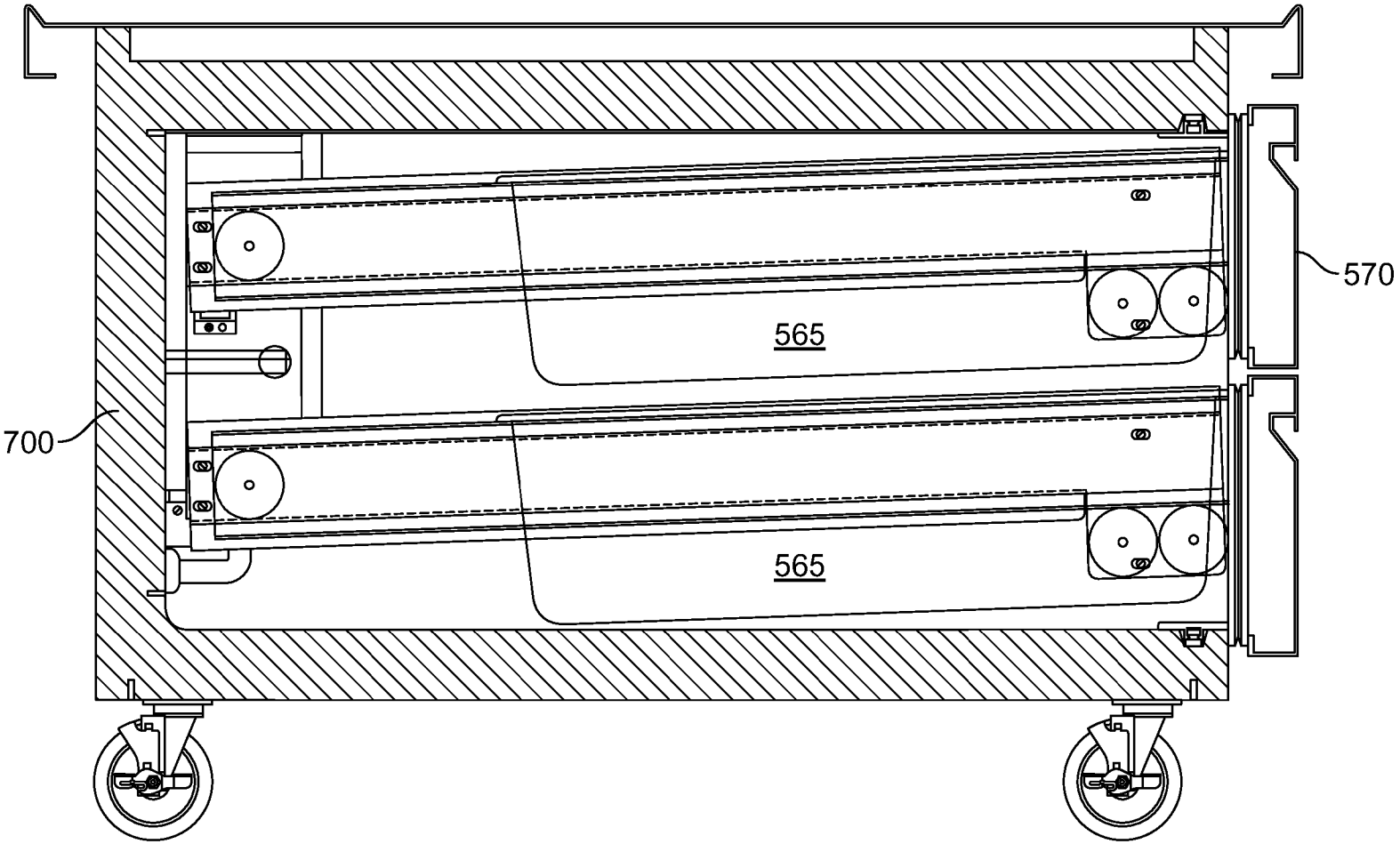
FIG. 11 depicts a sectional view of a disclosed embodiment

FIG. 10 depicts an elevation view of a disclosed embodiment including a plurality of external draw covers 570 attached to drawers, the drawers shown in FIG. 11. FIG. 10 also shows the exterior section 575 optionally containing or covering a compartment for cooling systems.

FIG. 11 depicts a side section view of an optional drawer assembly comprising a plurality of drawers 560 attached to a door movement system or door roller system. A lower insulation system 700 is shown in attachment to the void area containing the drawers 560.

Figure 12:
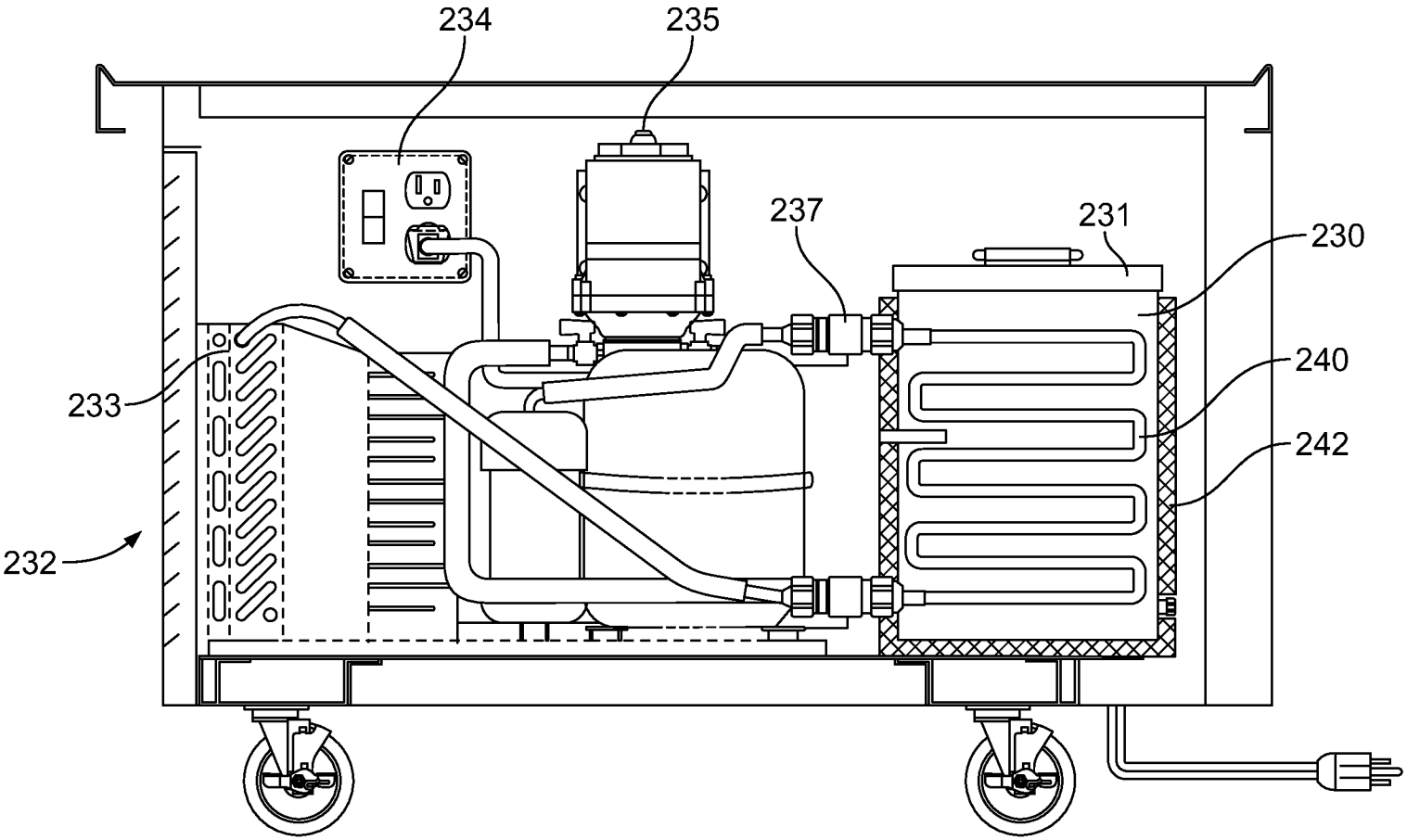
FIG. 12 depicts a sectional view of a disclosed embodiment

FIG. 12 depicts a side section view of a disclosed embodiment having a glycol tank 230, filed with glycol and containing a refrigerant line 240. The glycol tank may be surrounded by insulation 242 and covered by a lid 231.

Items

Disclosed embodiments include the following items.

Item 1. A food cooling system, the system comprising:

a) an inner liner 160, the inner liner comprising an outer wall 150 connected to an inner wall 120, the inner wall and outer wall defining a glycol void area 130, and an inside area of the inner wall defining a cooling area 110;

b) a refrigerant flow line 140 disposed within the glycol void area;

c) glycol disposed within the glycol void area, the glycol in contact with the refrigerant flow line;

d) the refrigerant flow line containing circulating refrigerant, the refrigerant cooled by use a compressor, condenser and evaporation coil;

e) the glycol within the glycol void area cooled by contact with the refrigerant flow line;

f) the glycol disposed within the glycol void area having a pipe line to a glycol tank 230, the glycol tank comprising glycol and a second refrigerant flow line, the second refrigerant flow line in direct contact with the glycol within the glycol tank cooling the glycol within the glycol tank; and g) a thermostat and control valve measuring the temperature within the cooling area, and connected to a glycol pump 235, the thermostat and control valve activating the glycol pump upon the cooling area exceeding a predetermined temperature.

Item 2. The system of item 1 further comprising a removable layer of insulation 175 in contact with the outer wall 150 of the inner liner 160;

Item 3. The system of item 1 further comprising a plurality of food pans 560 disposed within the cooling area 110 and a lid 520 attached with a hinge to a preparation table assembly 500, the lid, in a closed position preventing cooled air from reaching the food pans 560.

Item 4. The system of item 3 further comprising a tray shelf 510 attached to the preparation table assembly, and the tray shelf attached to a raised chamber 555, the raised chamber containing the inner liner and glycol void area 130, the raised chamber further containing a plurality of support bars.

Item 5. The system of item 4 wherein the preparation table assembly 500 further comprising a lower interior compartment 580 defined by a door 530, a floor 586, a back wall 587 and a ceiling 588, the back wall attached to an evaporation coil system 200.

Item 6. A method of cooling food, the method comprising:

a) using an inner liner 160, the inner liner comprising an outer wall connected to an inner wall, the inner wall and outer wall defining a glycol void area 130, and an inside area of the interal wall defining a cooling area 110;

b) using a refrigerant flow line 140 disposed within the glycol void area;

c) using glycol disposed within the glycol void area, the glycol in contact with the refrigerant flow line;

d) using the refrigerant flow line containing circulating refrigerant, the refrigerant cooled by use a compressor, condenser and evaporation coil;

e) using the glycol within the glycol void area cooled by contact with the refrigerant flow line;

f) using the glycol disposed within the glycol void area having a pipe line to a glycol tank 230, the glycol tank comprising glycol and a second refrigerant flow line, the second refrigerant flow line in direct contact with the glycol within the glycol tank cooling the glycol within the glycol tank; and g) using a thermostat and control valve measuring the temperature within the cooling area, and connected to a glycol pump 235, the thermostat and control valve activating the glycol pump upon the cooling area exceeding a predetermined temperature.

Item 7. The method of item 6 further using a removable layer of insulation 175 in contact with the outer wall 150 of the inner liner 160;

Item 8. The method of item 6 further using a plurality of food pans 560 disposed within the cooling area 110 and a lid 520 attached with a hinge to a preparation table assembly 500, the lid, in a closed position preventing cooled air from reaching the food pans 560.

Item 9. The method of item 8 further using a tray shelf 510 attached to the preparation table assembly, and the tray shelf attached to a raised chamber 555, the raised chamber containing the inner liner and glycol void area 130, the raised chamber further containing a plurality of support bars.

Item 10. The method of item 9 using the preparation table assembly 500 further comprising a lower interior compartment 580 defined by a door 530, a floor 586, a back wall 587 and a ceiling 588, the back wall attached to an evaporation coil system 200.

What is claimed is:

1. A food cooling system, the system comprising:

a) an inner liner, the inner liner comprising an outer wall connected to an inner wall, the inner wall and outer wall defining a glycol void area, and an inside area of the inner wall defining a cooling area;

b) a refrigerant flow line disposed within the glycol void area;

c) glycol disposed within the glycol void area, the glycol in contact with the refrigerant flow line;

d) the refrigerant flow line containing circulating refrigerant, the refrigerant cooled by use a compressor, condenser and evaporation coil;

e) the glycol within the glycol void area cooled by contact with the refrigerant flow line;

f) the glycol disposed within the glycol void area having a pipe line to a glycol tank, the glycol tank comprising glycol and a second freon flow line, the second refrigerant flow line in direct contact with the glycol within the glycol tank cooling the glycol within the glycol tank; and g) a thermostat and control valve measuring the temperature within the cooling area, and connected to a glycol pump, the thermostat and control valve activating the glycol pump upon the cooling area exceeding a predetermined temperature.

2. The system of claim 1 further comprising a removable layer of insulation in contact with the outer wall of the inner liner.

3. The system of claim 1 further comprising a plurality of food pans disposed within the cooling area and a lid attached with a hinge to a preparation table assembly, the lid, in a closed position preventing cooled air from reaching the food pans.

4. The system of claim 3 further comprising a tray shelf attached to the preparation table assembly, and the tray shelf attached to a raised chamber, the raised chamber containing the inner liner and glycol void area, the raised chamber further containing a plurality of support bars.

5. The system of claim 4 wherein the preparation table assembly further comprising a lower interior compartment defined by a door, a floor, a back wall and a ceiling, the back wall attached to the evaporation coil.

6. A method of cooling food, the method comprising:

a) using an inner liner, the inner liner comprising an outer wall connected to an inner wall, the inner wall and outer wall defining a glycol void area, and an inside area of the internal wall defining a cooling area;

b) using a refrigerant flow line disposed within the glycol void area;

c) using glycol disposed within the glycol void area, the glycol in contact with the refrigerant flow line;

d) using the refrigerant flow line containing circulating refrigerant, the refrigerant cooled by use a compressor, condenser and evaporation coil;

e) using the glycol within the glycol void area cooled by contact with the refrigerant flow line;

f) using the glycol disposed within the glycol void area having a pipe line to a glycol tank, the glycol tank comprising glycol and a second refrigerant flow line, the second refrigerant flow line in direct contact with the glycol within the glycol tank cooling the glycol within the glycol tank; and g) using a thermostat and control valve measuring the temperature within the cooling area, and connected to a glycol pump, the thermostat and control valve activating the glycol pump upon the cooling area exceeding a predetermined temperature.

7. The method of claim 6 further using a removable layer of insulation in contact with the outer wall of the inner liner.

8. The method of claim 7 further using a plurality of food pans disposed within the cooling area and a lid attached with a hinge to a preparation table assembly, the lid, in a closed position preventing cooled air from reaching the food pans.

9. The method of claim 8 further using a tray shelf attached to the preparation table assembly, and the tray shelf attached to a raised chamber, the raised chamber containing the inner liner and glycol void area, the raised chamber further containing a plurality of support bars.

10. The method of claim 9 using the preparation table assembly further comprising a lower interior compartment defined by a door, a floor, a back wall and a ceiling, the back wall attached to the evaporation coil.

* * * * *